US005240344A

United States Patent [19]

Green

[11] Patent Number: 5,240,344

[45] Date of Patent: Aug. 31, 1993

[54] ROAD OR STREET LANE MARKERS

[76] Inventor: William P. Green, 3570 E. Lombardy Rd., Pasadena, Calif. 91107

[21] Appl. No.: 600,399

[22] Filed: Oct. 19, 1990

[51] Int. Cl.[5] ..... G08B 1/00; E01F 11/00

[52] U.S. Cl. ..... 404/14; 404/16; 404/15

[58] Field of Search ..... 404/14, 16; 350/103, 350/613, 97

[56] References Cited

U.S. PATENT DOCUMENTS

| | | | |
|---|---|---|---|
| 3,519,327 | 7/1970 | Nakajima | 404/14 X |
| 3,627,403 | 12/1971 | Hedgewick | 404/14 X |
| 3,836,226 | 9/1974 | Cechetini | 404/14 X |
| 4,076,383 | 2/1978 | Heasley | 404/14 X |
| 4,234,265 | 11/1980 | Otis | 404/16 |
| 4,609,266 | 9/1986 | Blom | 350/613 |
| 4,674,850 | 6/1987 | Blom | 350/613 |
| 4,726,706 | 2/1988 | Attar | 404/14 |

*Primary Examiner*—Ramon S. Britts
*Assistant Examiner*—Nancy P. Connolly
*Attorney, Agent, or Firm*—William P. Green

[57] ABSTRACT

A lane marker which is attached to the surface of a road to define the boundary between two lanes, and which is adapted to receive light from the headlights of a rear one of two vehicles traveling in the same direction on the road and direct a portion of that light forwardly from the marker for viewing from the forward vehicle, to indicate to the driver of the forward vehicle the position of the rear vehicle with respect to the marker. The device includes a prism or other light directing unit or assembly acting by refraction and/or reflection to aim the light forwardly within a preferably limited angle assuring sufficient intensity of the light for effective viewing by the driver of the forward vehicle. The device may also reflect some of the light back to the trailing vehicle for viewing by its driver.

26 Claims, 5 Drawing Sheets

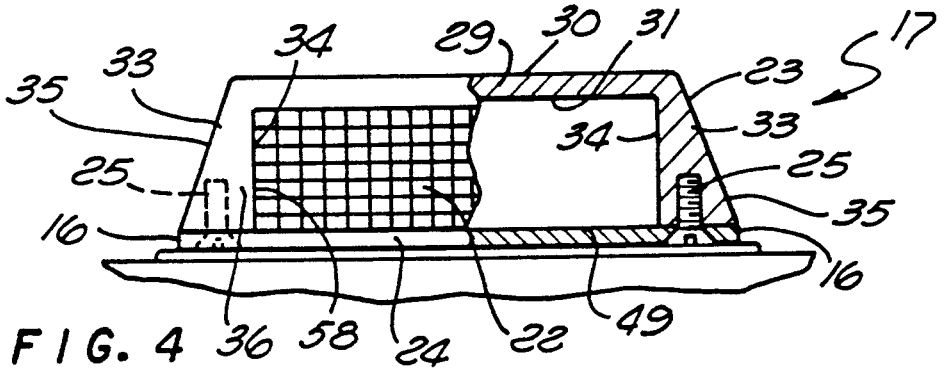
FIG. 4
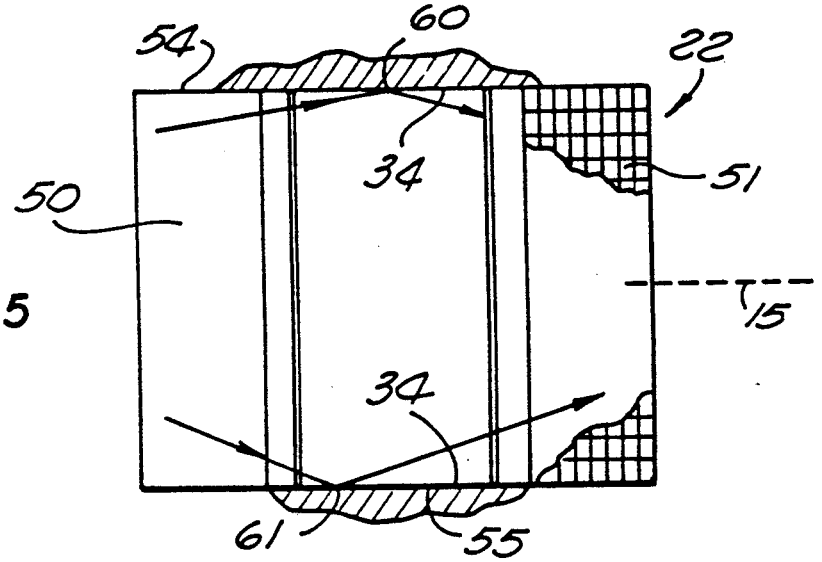
FIG 5
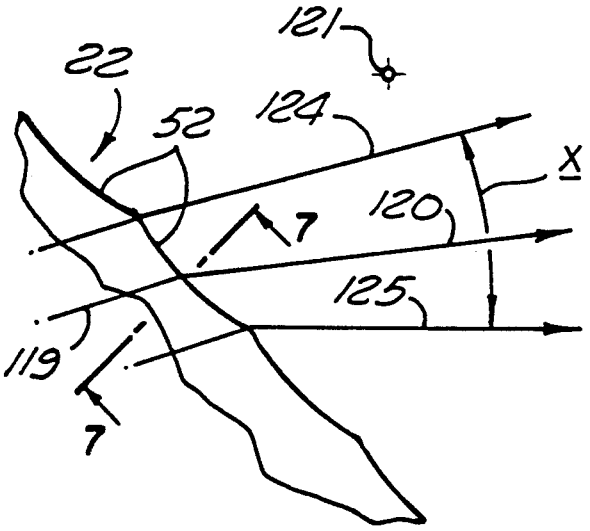
FIG. 6
FIG. 7
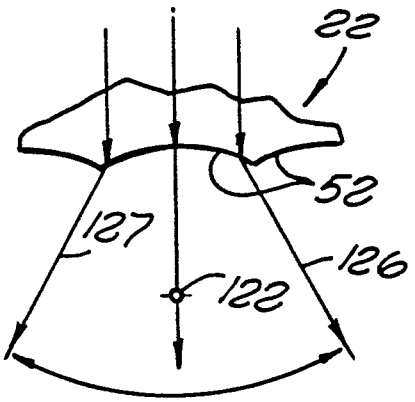

ROAD OR STREET LANE MARKERS

This invention relates to improved markers for indicating to the driver of a vehicle at night where the dividing lines between different lanes or other areas of a road or street are located.

BACKGROUND OF THE INVENTION

When traveling by automobile at night, it is often difficult to see the markings which outline the different lanes of a road, and is therefore difficult to assure against encroachment upon a lane or portion of the road utilized by another vehicle. To overcome this problem, lane markings may be formed with reflective paint, or be provided with reflective markers, in order to reflect light from a vehicle's headlights back to the driver of the vehicle and thereby render the lanes more readily visible.

Such reflective paints and markers are very helpful in enabling the driver of a vehicle to see the lanes ahead of him, but are of no assistance at all in viewing the lanes behind, or in determining the particular lane in which a vehicle coming up from behind is traveling. Consequently, a driver attempting to enter a freeway, or attempting to change lanes, may be forced by the limitations of time to make the desired change without full knowledge of whether the lane into which he is moving is already occupied by another vehicle approaching from behind. If the driver's appraisal of the situation is wrong, a serious accident may result.

SUMMARY OF THE INVENTION

A major purpose of the present invention is to provide improved road markers which can be seen at night in the rear view mirror of a leading one of two vehicles traveling in the same direction, to indicate to the driver of the leading vehicle the position of the trailing vehicle with respect to a particular lane of the road. To attain this result, a marker embodying the invention is constructed to receive light emitted from the headlights of the rear vehicle and direct some of that light forwardly for viewing from the leading vehicle. Light from the rear vehicle is preferably directed through the interior of each marker and then forwardly from a forward face thereof. Light from the headlights of the rear vehicle may enter a rear window, and be directed by refractive and/or reflective means through and forwardly from a front window. A prism, lens, mirror or combination of such elements preferably confines the emitted light to a limited forward angle, preferentially aiming the light in concentrated fashion within a region visible to the driver of a leading vehicle. For this purpose, the forward beam of light may be limited to a small angle vertically and a small angle horizontally, both of which are just sufficient to assure effective viewing of the light from any forward vehicles which may be present.

A marker embodying the invention may also be constructed to reflect some of the light from the headlights of the following vehicle back toward that vehicle, so that the marker is readily visible by the drivers of both vehicles.

BRIEF DESCRIPTION OF THE DRAWINGS

The above and other features and objects of the invention will be better understood from the following detailed description of the typical embodiments illustrated in the accompanying drawings, in which:

FIG. 4 is a partially sectional and partially elevational view taken on line 4—4 of FIG. 3;

FIG. 5 is a plan view of the inner light refracting and reflecting prism element of the marker of FIGS. 2 to 4, and may be considered as taken on line 3—3 of FIG. 2 with the top of the housing of the marker broken away to reveal the prism element;

FIG. 6 is an enlarged fragmentary vertical section through a portion, of the right end face of the prism and typically taken on line 6—6 of FIG. 3;

FIG. 7 is fragmentary transverse section taken on line 7—7 of FIG. 6;

DESCRIPTION OF THE PREFERRED EMBODIMENTS

Figure 1:
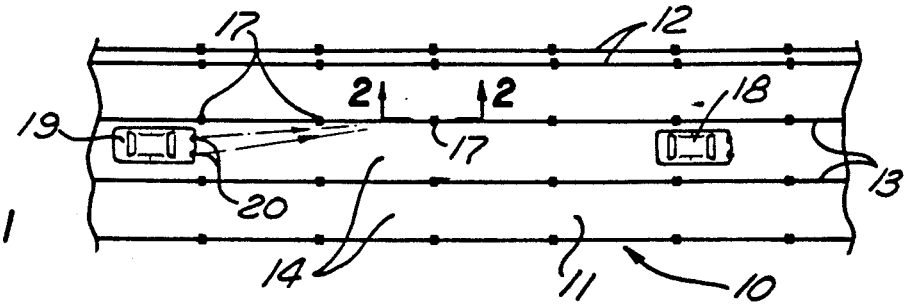
FIG. 1 is a diagrammatic plan view representation of a portion of a highway having markers constructed in accordance with the invention.

Referring first to FIG. 1, the highway 10 there illustrated has its horizontal road surface 11 typically marked off by two parallel painted yellow center lines 12 and a number of painted white parallel lines 13 dividing the road at each side of center lines 12 into a number of parallel lanes 14. A series of markers 17 constructed in accordance with the invention are attached to the road at spaced locations along each of the various lines 12 and 13, and may also be provided along crosswalks or other areas of significance.

To facilitate an understanding of the invention, FIG. 1 illustrates diagrammatically two automobiles or other vehicles 18 and 19 which may typically be traveling along the same lane in a rightward direction, with the vehicle 18 leading the vehicle 19 by a substantial distance. The markers 17 which are behind the leading vehicle 18 (to the left of that vehicle in FIG. 1) but are ahead of the trailing vehicle 19 receive light from the headlights 20 of vehicle 19 and direct that light in a manner making it visible to the driver of the leading vehicle 18 through his or her rear view mirrors, so that under night driving conditions the boundaries of the different lanes are outlined to the driver of vehicle 18 as an aid in enabling him to avoid an accident. For example, if the driver of vehicle 18 wishes to change lanes or is entering a freeway from an on-ramp, the markers assist the driver in determining whether the lane which he desires to enter is available. In some forms of the invention, markers 17 also serve the purpose of reflecting some of the light from the headlights of trailing vehicle 19 back to the driver of that vehicle, to define the lanes visually to that driver, or alternatively additional conventional reflective markers can be provided along the various lines for illuminating the boundaries of the lanes in conventional manner to the driver of vehicle 19.

A first form of marker 17 which may be utilized in accordance with the invention is illustrated in FIGS. 2 through 7. That marker 17 includes a rigid high strength hollow housing 21 which is connected in fixed position to the horizontal surface 11 of the road, and which projects upwardly above the surface 11 a substantial distance, say for example, about one inch, so that as the tires of an automobile or other vehicle contact or drive over one or more of the markers 17 the feel and sound of the contact apprises the driver that he or she has reached the edge of a lane or is moving from one lane or area of the road to another. A light transmitting prism or lens element 22 within housing 21 receives light from headlights 20 of vehicle 19 and directs at least a portion of that light through the interior of the housing and through prism 22 to leave the housing and prism from the right side of FIG. 2 for viewing from vehicle 18. Prism 22, like housing 21, is of sufficient strength to withstand forces exerted by a vehicle traveling over the marker without damage.

Figure 2:
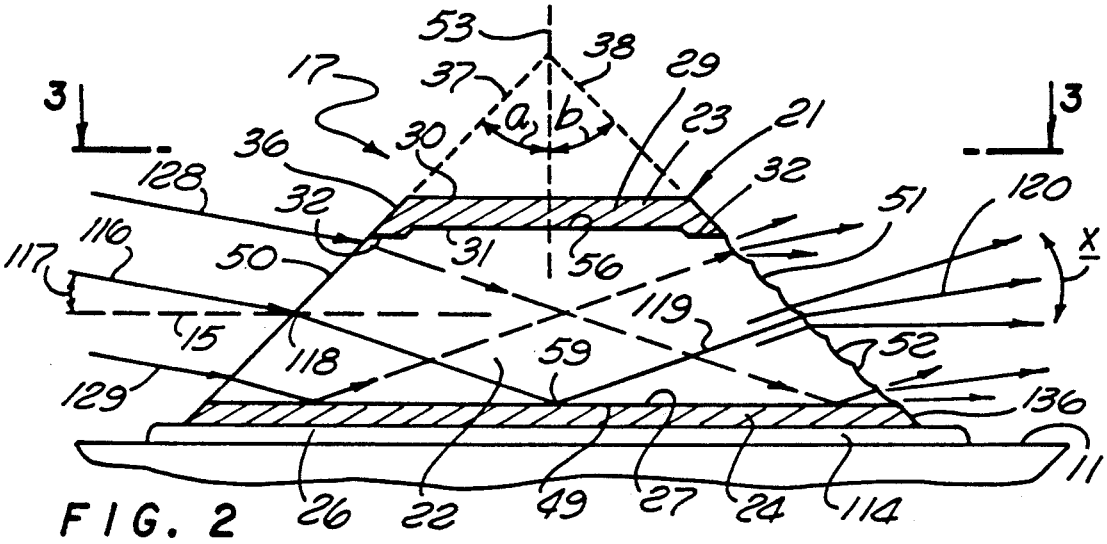
FIG. 2 is an enlarged vertical section through one of the markers, taken on line 2—2 of FIG. 1.
Figure 3:
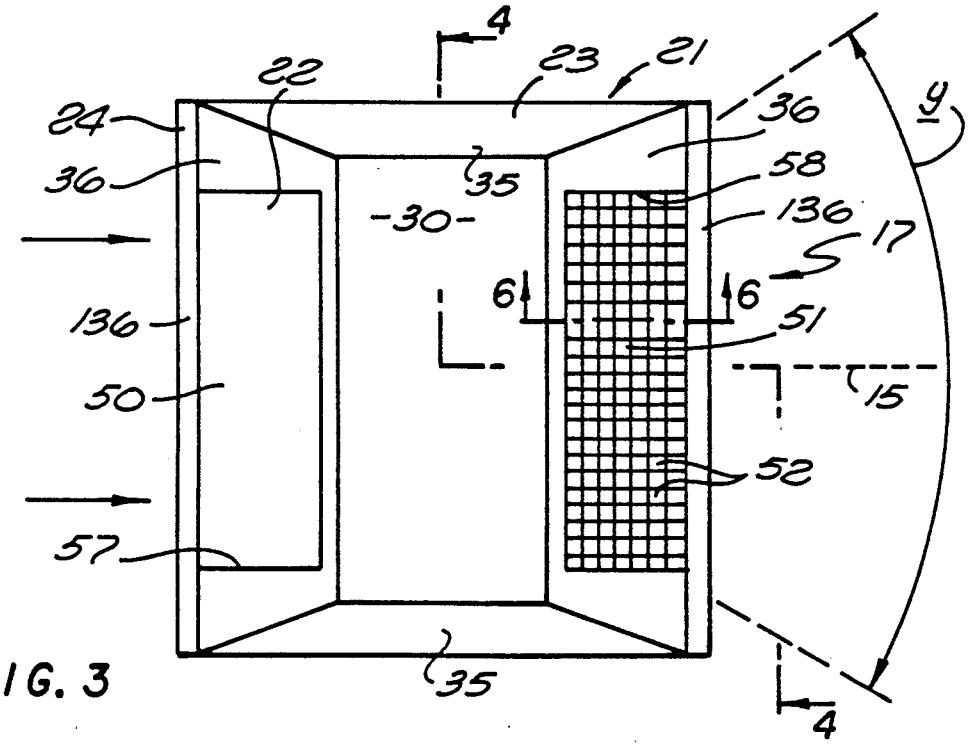
FIG. 3 is a plan view of the marker taken on line 3—3 of FIG. 2.

Housing 21 as illustrated in FIGS. 2 to 4 may be formed of steel or other rigid metal, and may be formed sectionally to include an upper hollow member 23 closed at its underside by a horizontal bottom wall 24 secured to section 23 by screws or other fasteners represented at 25 in FIG. 4. Bottom wall 24 has a horizontal undersurface 26 which may be bonded rigidly to the road surface 11 by a layer of epoxy or other cement 14, or by other means, and has an upper horizontal surface 27. Upper section 23 of the housing forms a top wall 29 having upper and lower parallel horizontal surfaces 30 and 31, with transverse flanges 32 projecting downwardly a short distance at the forward and rear ends respectively of top wall 29 for assisting in holding the prism in position.

Formed integrally with top wall 29, section 23 of the housing has two side walls 33 (FIG. 4) projecting downwardly at opposite sides of and closely fitting prism 22. These side walls 33 have parallel vertical planar inner surfaces 34 extending parallel to a central horizontal axis 15 of the marker, which axis is in turn parallel to the various lane defining lines 13 and to the direction of travel of the vehicles along road 10. At their outer sides, side walls 33 of section 23 of housing 21 have oppositely inclined surfaces 35 which extend downwardly and outwardly from opposite sides of the upper surface 30 of top wall 29 to the parallel opposite side edges 16 of bottom wall 24. Additional inclined surfaces 36 are formed at the opposite ends of housing section 23 (the left and right ends as viewed in FIGS. 2 and 3), with those surfaces 36 lying in two inclined planes 37 and 38 (FIG. 2) which may be perpendicular to one another and to the planes of inner surfaces 34 of side walls 33. Along its transverse edges, bottom wall 24 of the housing has inclined edge surfaces 136 (FIGS. 2 and 3) which are inclined in correspondence with and coplanar with, and merge with and form continuations of, surfaces 36 of upper section 23 of the housing.

Prism 22 may be formed of a single solid piece of transparent material, such as a transparent resinous plastic material or glass, and may have a planar horizontal undersurface 49 which engages horizontal upper surface 27 of bottom wall 24 of the housing. At its left end as viewed in FIG. 2, prism 22 has an inclined planar surface 50 lying in plane 37, and at its right end element 22 has a surface 51 which may be formed with typically identical facets or irregularities 52 preferably distributed across the entire area of surface 51. The faceted surface 51 lies generally within inclined plane 38. In the arrangement of FIG. 2, surfaces 50 and 51 are inclined the same number of degrees from the horizontal; and are disposed perpendicular to one another and at identical angles a and b (45 degrees) with respect to a central vertical plane 53 perpendicular to the front to rear axis 15 of the device. It is contemplated, however, that in some instances surface 51 may be inclined at a different angle than surface 50 to the horizontal, and these surfaces may be disposed at an angle other than 90 degrees to one another and at angles other than 45 degrees to plane 53.

At its opposite sides, the transparent prism element 22 has planar parallel vertical side surfaces 54 and 55 (FIG. 5) which engage surfaces 34 of the housing and which are parallel to and spaced equidistantly from central front to rear axis 15 of the marker. It is also noted that surfaces 54 and 55 are perpendicular to the two inclined planes 37 and 38. The top of prism 22 may project upwardly between flanges 32 of the top wall of the housing, for confinement therebetween, with an upper horizontal surface 56 of the prism engaging undersurface 31 of top wall 29 of the housing. The undersurface 49, upper surface 56, and opposite side surfaces 54 and 55 of prism 22 are polished or otherwise formed to very smooth mirror like configuration to render these surfaces internally specularly reflective, for directing light impinging thereon from headlights 20 toward the right end of prism 22 as viewed in FIG. 2. Similarly, the inclined faces 50 and 51 may be polished or otherwise rendered smooth to effectively refract the light in the manner discussed hereinafter.

The light from the headlights of vehicle 19 in FIG. 1 enters prism 22 through inclined surface 50, which may be rectangular as seen in FIGS. 3 and 4 and is contained within a rectangular window 57 formed by the housing. The light passes through transparent prism 22 and leaves the right end of the housing as viewed in FIG. 2 through faceted surface 51 contained within a rectangular window 58 formed at that end of the housing. Any rays of the light which enter window 57 and then impinge upon the bottom surface 49 of prism 22 are totally internally reflected by that surface as represented at 59, to ultimately leave the housing through exit surface 51 of the prism. Similarly, any light entering the left end of the housing which impinges upon either of the side surfaces 54 or 55 will be totally internally reflected by such surface as represented at 60 and 61 in FIG. 5 and thus directed toward the exit surface 51. Any light which may strike top surface 56 of the prism will also be totally internally reflected toward exit surface 51. Some of the rays of light entering the left end of the device in FIG. 2 may be reflected successively by two or more of the surfaces 49, 54, 55 or 56, in a manner ultimately directing substantially all of the light which enters the left end of the device outwardly through exit face 51. The light which leaves exit face 51 is aimed forwardly by the marker, approximately horizontally and near the road surface, to be visible in the rear view mirror of any vehicle ahead of the marker.

The prism 22 as illustrated in FIGS. 2 to 7 may typically be considered as a truncated right angle prism of the type referred to as a "Dove" prism. The arrows in FIG. 2 illustrate the manner in which the rays of light from a vehicle such as automobile 19 in FIG. 1 are refracted and reflected by the prism of a marker located approximately directly ahead of the vehicle. In FIG. 2, a typical ray of light 116 from vehicle 19 is assumed for purposes of discussion and explanation to be disposed within a vertical plane parallel to front to rear axis 15 of the marker. Ray 116 approaches light entrance face 50 of the prism within that plane at a slight downward angle 117, and is refracted downwardly by that face at 118. This light is totally internally reflected by bottom surface 49 of the prism at 59, to follow the path 119 toward exit face 51, at which the ray is refracted by face 51 toward a more horizontal but still slightly upwardly angled path 120.

The facets 52 of prism surface 51 preferably act to spread the forwardly aimed beam of light vertically within a small angle x above the plane of the road surface (FIGS. 2 and 6), and laterally within a limited horizontal angle y (FIG. 3). These angles are just sufficient to assure effective viewing of the light by the driver of a leading vehicle within any of the lanes of the road, without excessive dispersion of the light too high above the road surface or to other unwanted areas with resultant weakening of the light intensity in the desired reception area. As seen in FIGS. 6 and 7, the facets 52 of prism surface 51 may be designed for the desired limited dispersion of the light by forming each facet as a smooth concave negative lens surface having curvature in both vertical and transverse planes to spread the light both vertically and laterally. The facet surface may be of partial toroidal configuration, and is desirably astigmatic, to spread the light through a greater angle laterally or horizontally (angle y) than vertically (angle x).

FIG. 6 shows the curvature of the individual facets in a vertical plane parallel to front to rear axis 15, and FIG. 7 shows the curvature of the individual facets in a transverse plane perpendicular to the plane of FIG. 6. In FIG. 6, one of the facets is illustrated as curving arcuately in vertical section about a center 121. In FIG. 7, the same facet is illustrated as curving arcuately in transverse section about a center 122. Each facet preferably has the curvature illustrated in FIG. 6 in all vertical planes across the width of the facet, and has the curvature illustrated in FIG. 7 in all transverse planes parallel to the plane of FIG. 7, The particular light ray represented at 119 in FIG. 2 is illustrated as passing through the center of one of the facets 52 of surface 51, at which point the inclination of surface 51 corresponds to that of plane 38, with resultant refraction of the ray 119 to follow the path 120. Light passing through the same facet along a path parallel to ray 119 but above or beneath the center of the facet is refracted slightly upwardly or downwardly relative to the path 120, as illustrated at 124 and 125 in FIG. 6, thus spreading the light slightly to assure that it will be visible from the leading vehicle 18. Similarly, light passing through the center of the facet in FIG. 7 is not refracted laterally, while light to either side of the center is refracted slightly as represented at 126 and 127 to spread the light laterally (horizontally) for visibility in any of the different lanes ahead of the marker. It presently appears that the angle x within which the light is spread vertically may in some instances be between about 5 and 25 degrees, while the angle y of lateral spread may be greater than angle x and typically between about 25 and 70 degrees.

All rays of light which enter the prism through surface 50 and are parallel to ray 116 of FIG. 2 are refracted and reflected by the prism in the above discussed manner. Two such rays near the upper and lower edges of surface 50 are illustrated at 128 and 129 in FIG. 2. Each of these rays is refracted downwardly at surface 50, then internally reflected by surface 49, and ultimately exits the prism through and is refracted by one of the facets of surface 51. It will thus be apparent that all light entering the prism parallel to ray 116 is aimed forwardly by facets 52 in controlled directional fashion within the angles x and y of FIGS. 2 and 3. Light entering the prism at slightly different angles than ray 116 may be refracted and reflected slightly differently but still tends to be confined largely within the desired angles for viewing from a leading vehicle.

The light exit face 51 of prism 22 may be partially reflective, so that some of the light impinging upon that surface from the rear is reflected back through the prism to return rearwardly through back surface 50 of the prism toward the trailing vehicle 19 for viewing by the driver of that vehicle, to thereby outline to him the boundaries of the different lanes. Such partial reflection from surface 51 may be attained in any convenient manner, as by internal reflection within the prism and/or by a partially reflective coating provided on the forward surface 51 of the prism. Any light which is reflected rearwardly by surface 51 in a direction to contact bottom surface 49, upper surface 56, or side surface 54 or 55 of the prism will be totally internally reflected by such surfaces in a manner assuring ultimate passage of that light rearwardly out through the back face 50 of the prism and toward the trailing vehicle. Thus, light from the headlights of that vehicle is directed by the prism in part toward the leading vehicle 18 and in part back toward the trailing vehicle 19 to be viewed by the drivers of both of those vehicles.

Figure 8:
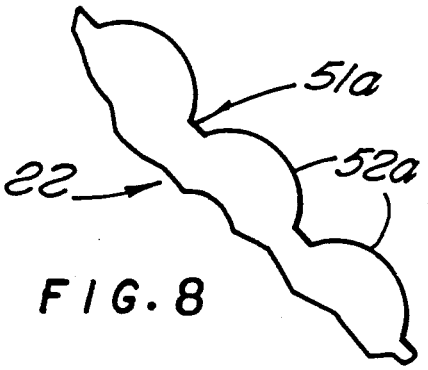
FIGS. 8 and 9 are fragmentary vertical sections similar to FIG. 6, but showing two variational types of prism elements.

In lieu of the concave negative lens facets illustrated at 52 in FIGS. 2, 6 and 7, the forward surface 51 of prism 22 may be given any of various other types of configuration which may be felt desirable for appropriately controlling the amount of light passing forwardly through surface 51, or the amount of light if any which is reflected rearwardly by that surface for return to the trailing vehicle, or for controlling the vertical and horizontal angles x and y within which the light directed forwardly by the prism is aimed, or the corresponding vertical and horizontal angles within which light reflected back through rear face 50 and toward the trailing vehicle is aimed. Some of the possible variational configurations for the forward surface 51 of the prism are illustrated in FIGS. 8 through 14. For example, FIG. 8 shows an arrangement in which the forward surface 51*a* of the prism 22, corresponding to surface 51 of FIG. 2, has facets 52*a* of convex rather than concave shape. These facets are thus in effect small positive lens surfaces, and may be spherically curved. The facets 52*a* of FIG. 8 may be distributed at closely spaced locations across the entire area of the forward face 51*a* of the prism. These facets may be dimensioned and shaped to appropriately disperse the forwardly directed light for viewing from different forward vehicles, and may also be designed to give any desired amount of internal reflection within the prism to return a portion of the light rearwardly through the prism and to the driver of the trailing vehicle.

Figure 9:
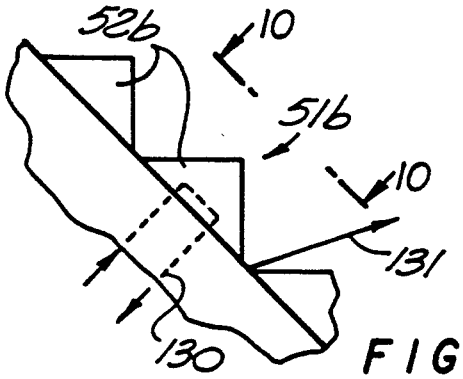
Figure 10:
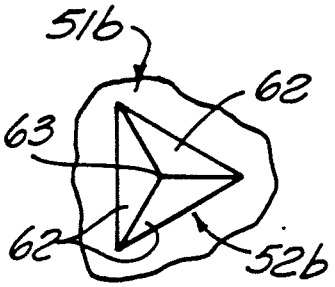
FIG. 10 is a fragmentary elevational view taken on line 10—10 of FIG. 9 showing one of the facets of the FIG. 9 prism.

FIGS. 9 and 10 show another arrangement in which the facets 52*b* on the forward face 51*b* of the prism 22 are shaped as corner reflectors, each defined by three mutually perpendicular planar surfaces 62 meeting at a point 63 facing generally forwardly. Some of the light traveling forwardly within the prism passes through surface 51*b* between facets 52*b*, with slight refraction thereby for viewing from the leading vehicle, while other light impinging on the interior of the corner reflectors is in large part reflected internally by the surfaces 62 of the reflectors back through the prism along essentially the same line that the light followed in approaching the forward face 51*b* (as represented diagrammatically at 130 in FIG. 9). Each such rearwardly reflected ray of light is totally internally reflected by any bottom, side or top surface or surfaces of the prism which it may strike, and thus by multiple reflection may ultimately emit rearwardly directly toward the headlight by which the same light originally was produced. This directional effect returns enough light to the driver of the trailing vehicle to make the marker readily visible to him or her, while light passing forwardly through and refracted by the front face 51*a* of the prism (e.g. at 131 in FIG. 9) makes the marker also visible to the driver of the leading vehicle.

Figure 11:
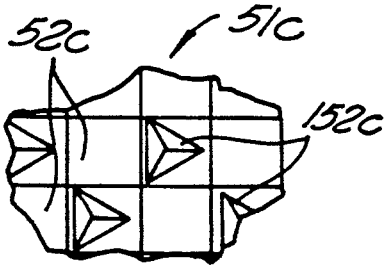
FIG. 11 is a fragmentary elevational view taken on a line corresponding to the line 10—10 of FIG. 9, but showing another variational form of prism.

FIG. 11 illustrates a variation in which exit face 51*c* of the prism has two sets of facets 52*c* and 152*c* both spaced across the entire area of face 51*c*. Facets 52*c* may be curved concavely and astigmatically in correspondence with facets 52 of FIGS. 6 and 7, while facets 152*c* are corner reflectors as shown at 52*b* in FIGS. 9 and 10. Facets 52*c* thus serve primarily to direct light forwardly toward the leading vehicle or vehicles, within controlled angles as discussed, while facets 152*c* reflect light back to the trailing vehicle.

Figure 12:
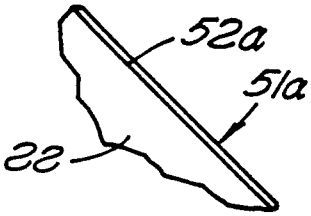
FIG. 12 is a view corresponding to FIGS. 6, 8, 9 and 11 showing another form of prism having a planar light exit face.

FIG. 12 shows another form of the invention, in which the forward face 51*d* of prism 22 is completely flat and planar and disposed within plane 38 of FIG. 2, with no facets provided on surface 51*d*, so that the light from the prism passes forwardly through surface 51*c* without spreading but with slight refraction as a result of the inclination of surface 51*d*. Surface 51*d* may or may not have a coating 52*d* for affecting the light transmission or reflecting characteristics of the surface in a desired manner. For example, coating 52*d* may be formed of a partially reflective material to reflect some of the light back to the trailing vehicle, while passing another portion of the light forwardly to the leading vehicle. It is additionally contemplated that the facets of the light exit face of any of the other forms of the invention may be coated to be partially reflective or to attain another desired result.

Figure 13:
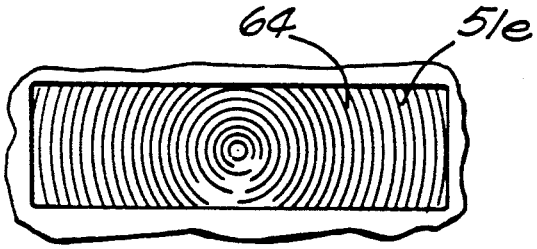
FIGS. 13 and 14 are end elevational views taken on a line corresponding to the line 10—10 of FIG. 9, but showing two additional variational prism elements.

FIG. 13 is a front elevational view similar to the elevational portion of FIG. 4, showing somewhat diagrammatically another arrangement in which the typically rectangular forward light exit face 51*e* of prism 22 may be shaped as a fresnel lens, having lens segments or ridges represented at 64 shaped to give the forward face 51*e* the optical characteristic of any desired lens felt desirable for attaining proper directional control and distribution of the forwardly directed light viewed from the leading vehicle. The fresnel lens formed in this manner may be shaped to provide either a positive lens effect or a negative lens effect as preferred, and may be astigmatic. It is presently felt preferably in certain instances that the fresnel lens surface 51*e* be the equivalent optically of the astigmatic negative lens facets of FIGS. 6 and 7.

Figure 14:
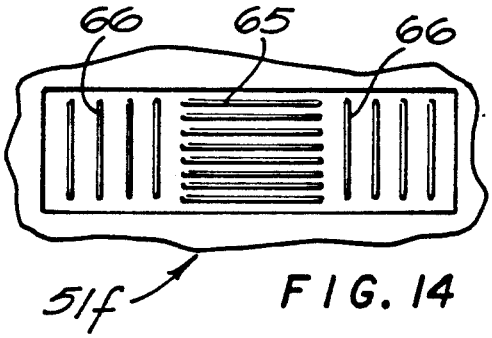

FIG. 14 represents a similar arrangement in which the light exit face 51*f* has a number of linear horizontally extending lens segments or ridges 65 and linear vertically elongated segments or ridges 66, as in the lenses of some automobile headlights, to function in essentially the manner of a fresnel lens for determining the vertical and horizontal spread of the light leaving the prism and viewed by the driver of a leading vehicle. As will be understood, the representation of the lens or prism facets or segments in FIG. 14 is diagrammatic, and the actual facet configuration is to be selected in accordance with well known optical principles to attain the desired horizontal and vertical light exit angles within which light is aimed forwardly toward the leading vehicle or vehicles, and to attain any desired reflection back toward the trailing vehicle.

Figure 15:
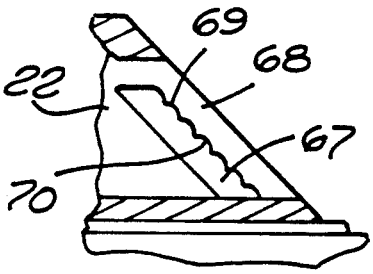
FIG. 15 is a fragmentary vertical section through the right end portion of another form of prism element.

In the arrangement of FIG. 15, prism 22 is shaped to have a bottom recess 67 defining a forward window portion 68 of the prism on whose rear surface 69 a series of facets 70 may be formed. These facets may have the configuration of any of facets 52, 52*a*, 52*b*, 52*c*, 152*c*, 64, 65 or 66. Also, surface 69 may be coated or treated to be partially reflective or may have any other shape or characteristic found desirable for appropriately aiming light emitted forwardly from the device and controlling the amount and direction of reflection of some of the light rearwardly back to the trailing vehicle.

Figure 16:
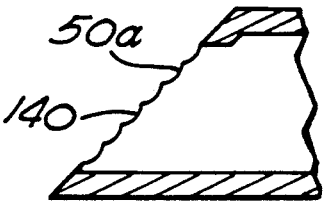
FIG. 16 is a fragmentary vertical section similar to the left end portion of FIG. 2 and showing a variation of the light entrance end of the prism.

In some instances, it may be desirable to provide the rear surface 50 of prism 22 of FIGS. 1 to 7 with facets and/or a coating, to attain a desired refraction or reflection of the light at that location. Such an arrangement is illustrated in FIG. 16, in which the rear surface 50*a* corresponding to surface 50 of FIG. 2 has concave facets 140 corresponding to those shown at 52 in FIGS. 6 and 7. Any of the other types of facets discussed previously may be utilized at surface 50, or any other desired arrangement for attaining a particular light control function. As one possibility, surface 50 may have a partially reflective coating which reflects some of the light from the headlights of vehicle 19 back toward that vehicle for viewing by that driver, but which also passes a substantial amount of the light through the surface and into the interior of prism 22 for delivery from the forward face 51 of the prism to the driver of the leading vehicle 18.

Figure 17:
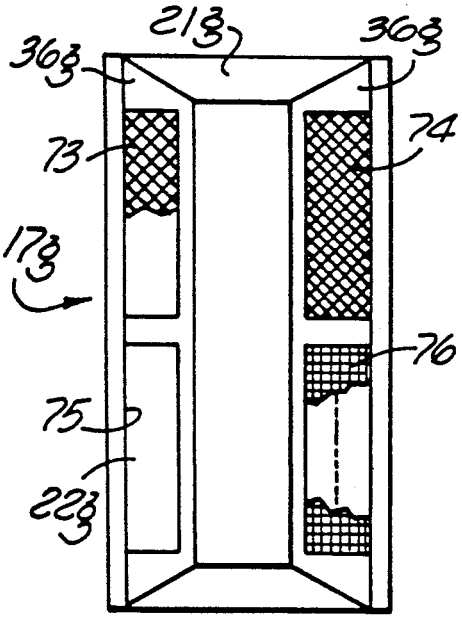
FIG. 17 is a plan view similar to FIG. 3 of a marker having a widened housing carrying a reflector element or elements in addition to the prism.

FIG. 17 shows a marker 17*g* which may be the same as that illustrated in FIGS. 1 through 7 except that the housing 21*g* in FIG. 17 is wider than the housing 21 of the first form of the invention, to allow mounting on the housing of rear and front directional reflectors 73 and 74 such as are utilized on some lane markers currently in use. Reflectors 73 and 74 may be attached to rear and forward inclined surfaces 36*g* of the housing and be inclined in correspondence therewith. The prism 22*g* in FIG. 17 may be identical with prism 22 of FIGS. 1 to 7, to receive light from a trailing vehicle through a rear window 75, and conduct that light forwardly through the interior of the prism for delivery forwardly from a front window 76 for viewing by the driver of a leading vehicle. In this arrangement, any facets formed on the forward face of the prism may be designed to pass substantially all of the light forwardly toward the leading vehicle, since the reflector strip 73 carried by the exterior of the widened portion of the housing serves the function of reflecting light back to the driver of the trailing vehicle. Strip 73 may be any of the known types of directionally reflective material currently used on road signs or the like for returning light selectively toward its source, such as, beaded surfaces, corner reflectors, etc. The reflector 74 at the forward side of the FIG. 17 marker may be provided for viewing by a driver traveling in a direction the opposite of vehicles 18 and 19 in FIG. 1.

Figure 18:
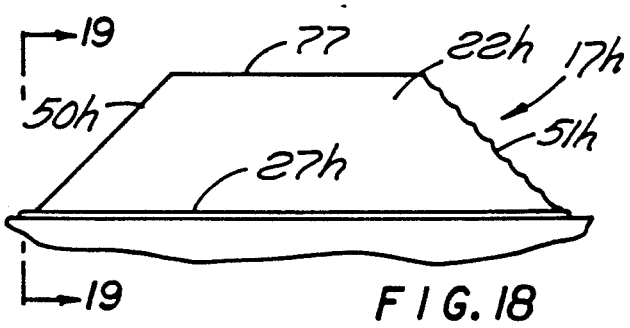
FIG. 18 is a side elevational view of a variational marker consisting of a prism without a housing.
Figure 19:
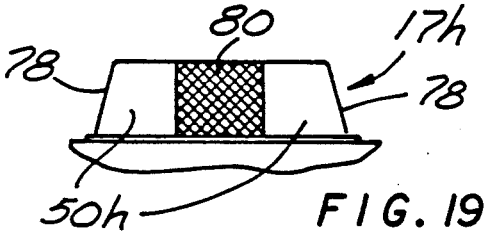
FIG. 19 is a reduced front elevational view taken on line 19—19 of FIG. 18.

The marker 17*h* of FIGS. 18 and 19 may be shaped externally the same as marker 17 of FIGS. 1 to 7, but be formed of a single piece of transparent material 22*h* rather than the two parts 21 and 22 of the first form of the invention. Light from a trailing vehicle may enter the rear inclined face 50*h* corresponding to surface 50 of FIG. 2, and after total internal reflection by the bottom surface 27*h* of transparent body 27*h*, or by any other surface of the prism contacted by the light, is emitted forwardly through inclined front surface 51*h* of the transparent body for viewing by the driver of a leading vehicle. Surface 51*h* may have facets corresponding to facets 52 of FIGS. 6 and 7, or may be otherwise faceted, or planar in any of the various manners previously discussed for appropriate aiming of the emitted light, and for partial reflection of the light back to the driver of the trailing vehicle if desired. Also, in addition to the principal light entry surface 50*h*, light may enter the interior of the transparent body 22*h* through top surface 77 or inclined side surfaces 78, and may also leave the body through top surface 77 or inclined surfaces 78, to increase the illuminated area visible to the drivers of both vehicles. The rear light entry face 50*h* may be completely transparent if desired, to allow entry of light through that surface over its entire area, or may carry a strip of reflective material represented at 80 in FIG. 19, covering a portion only of surface 50*h*, so that at the location of strip 80 light from the headlights of a trailing vehicle is reflected back directly toward that vehicle for viewing by its driver, while light passing forwardly through the remainder of the surface 50*h* passes through the interior of body 22*h* for emission forwardly toward the leading vehicle and viewing by its driver.

Figure 20:
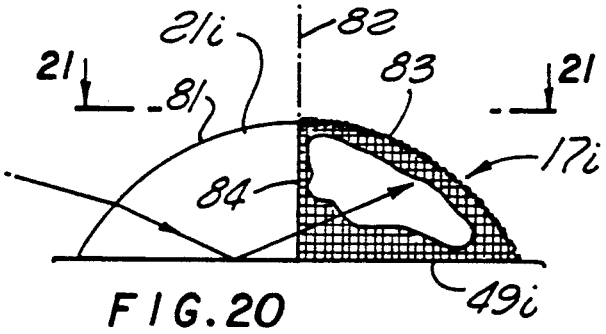
FIG. 20 is a side elevational view of a spherically shaped marker embodying the invention.
Figure 21:
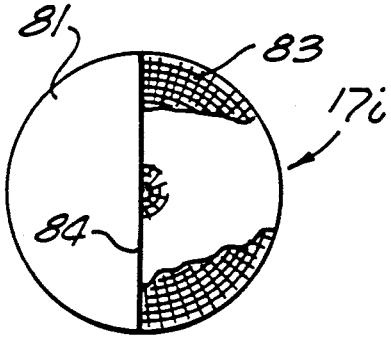
FIG. 21 is a reduced plan view taken on line 21—21 of FIG. 20.

FIGS. 20 and 21 show another form of marker 17*i* which is formed of a single piece 22*i* of transparent glass or plastic material, and which has a horizontal planar undersurface 49*i* and a convex preferably spherically curved upper surface 81 centered about a central vertical axis 82. Light from a trailing vehicle enters the transparent body 22*i* of FIGS. 20 and 21 from the left side of those figures, and is internally reflected within body 22*i* by bottom surface 49*i*, and/or by portions of the spherically curved surface 81 which may be contacted by the light, to ultimately reach the forward half of spherically curved surface 81. Facets 83 may be formed on the forward half of surface 81, forwardly of a line 84, to disperse the light and control the area within which it is visible and the direction in which it is emitted toward the driver of the leading vehicle. Facets 83 may be of any of the previously discussed configurations, and preferably are designed optically to direct the light within the angles x and y referred to previously, while also reflecting some light internally from the forward faceted portion of surface 81 back in a leftward direction as viewed in FIG. 20 for return toward the driver of the trailing vehicle. In this way, the spherically curved glass or plastic body 22*i* is illuminated for viewing by the drivers of both trailing and leading vehicles. It is also contemplated that in some instances the forward half of body 21*i* may be coated or otherwise treated to be partially reflective. In some cases, the rear half of body 21*i* may have facets, or be partially reflective. In the presently preferred arrangement, however, the external surface of the rear half of the body is smooth and unfaceted as illustrated.

Figure 22:
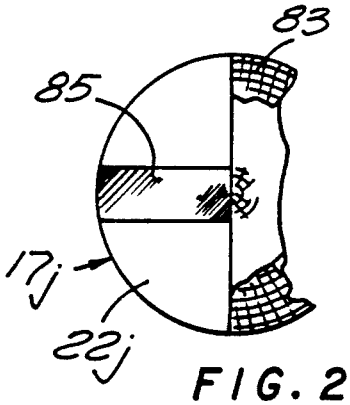
FIG. 22 is a fragmentary plan view similar to FIG. 21 and showing another form of marker.

The marker 17*j* of FIG. 22 may be the same as that illustrated in FIGS. 20 and 21, but with the addition of a strip of directionally reflective material 85 covering a central portion of the rear half of spherically curved transparent body 22*j*. Strip 85 is of conventional formation to reflect light from the headlights of an oncoming vehicle directly back toward the source of that light for viewing from the driver of that vehicle. Light entering body 22*j* at opposite sides of strip 85 passes forwardly through the transparent material of body 22*j* and through the facets 83 for viewing by the driver of the leading vehicle.

Figure 23:
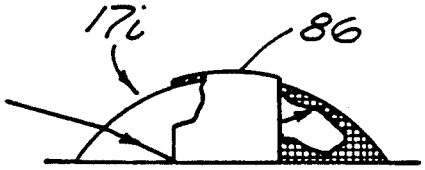
FIG. 23 is a side elevational view of another marker embodying the invention.

If desired, the marker 17*h* of FIG. 18, or the spherically curved marker 17*i* of FIGS. 20 and 21, or the marker 17*j* of FIG. 22, may be protected by a rigid member extending across a portion of the upper surface of that body and constituting a partial housing for the transparent element. Such an arrangement is illustrated in FIG. 23, in which an inverted generally U-shaped member 86 extends transversely across the upper side of the body 17*i* of FIGS. 20 and 21. This member 86 may be formed of a rigid metal, or the like, and leaves the transparent material unobstructed at the rear and front of member 86 for entry of light from the rear vehicle and emission of some or all of the light forwardly toward the leading vehicle.

Figure 24:
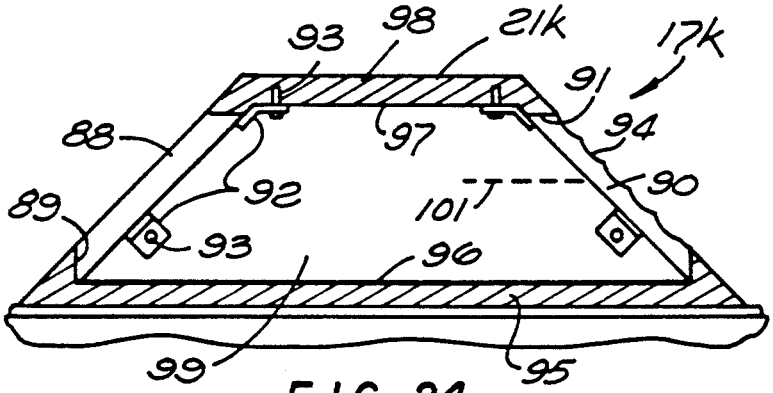
FIG. 24 is a vertical sectional view similar to FIG. 2 of another form of marker.

FIG. 24 illustrates another form of marker 17*k* having a rigid opaque housing 21*k* similar to the housing 21 of FIG. 2, with an inclined transparent light entrance window 88 of glass or resinous plastic material connected into a rectangular opening 89 at the location of inclined prism surface 50 in FIG. 2. At the opposite end of body 21*k*, an inclined transparent light exit window 90 is connected into a rectangular opening 91 at a location corresponding to surface 51 in FIG. 2. The transparent elements 88 and 90 may be secured to the housing in any suitable manner, as by brackets represented diagrammatically at 92 and attached to the housing by fasteners 93. Light enters window 89 from the headlights of a trailing vehicle such as that illustrated at 19 in FIG. 1, and passes forwardly through the hollow interior of housing 21*k* to exit forwardly through transparent window 90, which may have facets 94 preferably corresponding to facets 52 of FIGS. 6 and 7, or which may if desired be faceted, or planar and/or partially reflective, desirably to direct the light forwardly within an appropriate limited vertical angle and limited horizontal angle for viewing at maximum intensity by a driver of a leading vehicle. The bottom wall 95 of housing 21*k* has an upper horizontal specularly reflective mirror surface 96 for reflecting light impinging thereon toward window 90 in the same way that the bottom surface 49 of prism 22 reflects light in FIG. 2. Similarly, the undersurface 97 of top wall 98 of the housing has a horizontal mirror surface for reflecting light falling thereon, and the side walls of the housing have vertical parallel planar mirror surfaces 99 corresponding to reflective side surfaces 54 and 55 of FIG. 5 and extending parallel to the main central horizontal axis 101 corresponding to axis 15 of FIG. 2. The mirror surfaces 96, 97 and 99 may reflect light one or more times as it advances from left to right in FIG. 24, with the ultimate result that substantially all of the light entering through window 88 reaches the forward window 90. That transparent window may be designed to pass substantially all of the light received thereby forwardly to a leading vehicle within predetermined angles, or its facets or a coating may be constructed to reflect part of the light back through the interior of housing 21*k* and through window 88 for return to the location of the trailing vehicle, to be viewed by the driver of that vehicle. The arrangement of FIG. 24 thus serves essentially the same purpose discussed in detail in connection with FIGS. 1 through 7. The housing of FIG. 24 may of course also be widened as shown in FIG. 17 to accommodate reflector strips of the type illustrated at 73 and 74 in that Figure.

Figure 25:
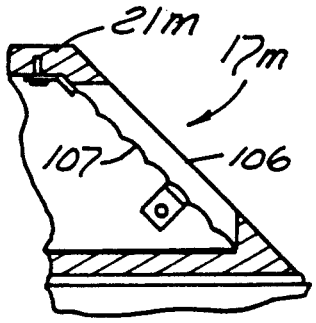
FIG. 25 is a fragmentary vertical section corresponding to a portion of FIG. 24 and showing another form of marker.

FIG. 25 shows fragmentarily another form of marker 17*m* which may be the same as that illustrated in FIG. 24 except that the forward transparent window 106 has facets 107 at its rear side, facing into the interior of the housing 21*m*, rather than the forwardly facing facets 94 of FIG. 24. The facets 107 are in most instances preferably of the type illustrated in FIGS. 6 and 7, but may if desired be of any of the other discussed types, or the surface may be planar and/or may be coated or treated to be partially reflective.

Figure 26:
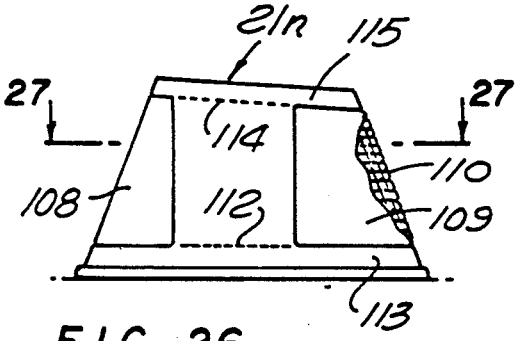
FIG. 26 is a side elevational view of another form of marker embodying the invention.
Figure 27:
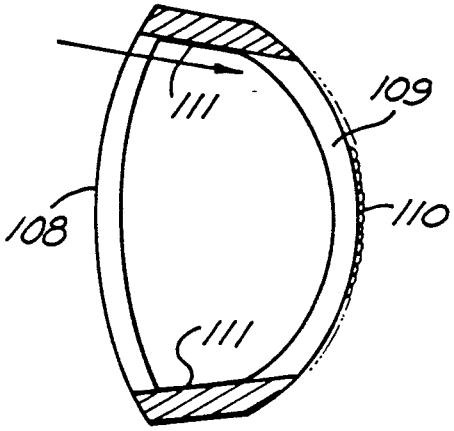
FIG. 27 is a horizontal section taken on line 27—27 of FIG. 26.

The form of the invention illustrated in FIGS. 26 and 27 includes a housing 21*n* of rigid metal or other material through which light passes from a transparent entrance window 108 to a transparent exit window 109 which may have facets 110 as shown in FIGS. 6 and 7 or of any of the other discussed types. Window 108 is curved arcuately as shown to receive light from a fairly wide area from trailing vehicles in different lanes, and the housing may converge to a smaller transverse dimension at the location of exit window 109. The inner surfaces 111 of the side walls of the housing, as well as the upper surface 112 of bottom wall 113, and the undersurface 114 of top wall 115, may all be provided with specularly reflective smooth mirror surfaces for reflecting any light impinging on these regions and directing it to reach exit window 109. Facets 110 may reflect a portion of the light, to render the marker visible from both leading and trailing vehicles, as discussed in connection with the other forms of the invention.

Figure 28:
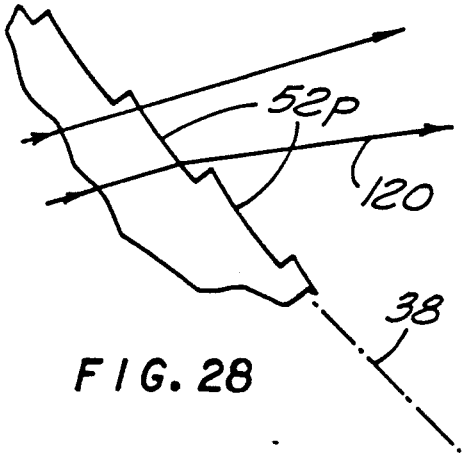
FIGS. 28 and 29 are fragmentary vertical sections similar to FIG. 6 of two other types of facets which may be provided on the light exit face of a prism such as that shown in FIGS. 1 to 5.
Figure 29:
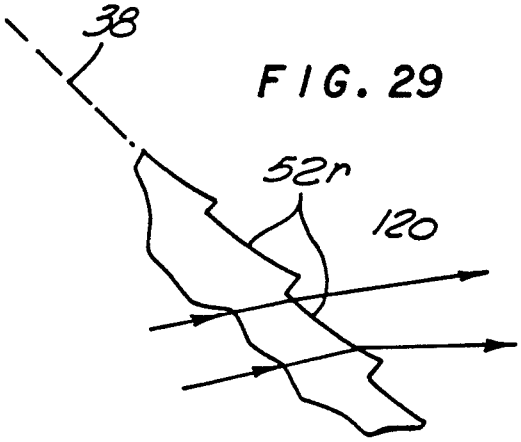

FIG. 28 shows a variation of the light exit facet configuration of FIG. 6. In FIG. 28, each of the facets 52*p* of a prism otherwise corresponding to the prism 22 of the first form of the invention is curved in correspondence with only the upper half of one of the facets 52 of FIG. 6, that is, the portion of the facet of FIG. 6 which spreads the light upwardly with respect to the line 120 of that Figure. In FIG. 28, the lower portion of each facet 52*p* lies essentially in the inclined plane 38 of FIG. 2, and as the facet surface advances upwardly, it curves progressively forwardly from that plane. FIG. 29 shows a similar arrangement in which facets 52*r* correspond to only the lower half of the facets 52 of FIG. 6, to spread the light only downwardly with respect to a line corresponding to line 120 of FIG. 6. In FIG. 29, the upper portion of each facet 52*r* lies essentially in plane 38, and in advancing downwardly from that location the facet surface curves progressively forwardly from plane 38.

In both FIG. 28 and FIG. 29, the facets preferably have the same type of transverse curvature as in FIG. 7. The partial facets of FIGS. 28 and 29 may be utilized in instances in which the geometry of the prism or lens assembly renders such facets desirable for the purpose of controlling the height of the forwardly projected beam.

While certain specific embodiments of the present invention have been disclosed as typical, the invention is of course not limited to these particular forms, but rather is applicable broadly to all such variations as fall within the scope of the appended claims.

I claim:

1. A road lane marker for use with other similar markers in defining a lane or lanes of a road;

said marker including light directing means operable, when the marker is between a forward vehicle and a rear vehicle traveling in the same direction on the road, to receive light emitted forwardly from the headlights of the rear vehicle to said marker and direct said light forwardly from said marker for viewing from said forward vehicle, to indicate to the driver of said forward vehicle the position of said rear vehicle with respect to said marker;

said light directing means including a prism through which light from the rear vehicle passes prior to emission forwardly from the marker;

said prism having an upwardly and forwardly inclined light inlet surface through which light enters the prism from said rear vehicle, and having a downwardly and forwardly inclined light exit surface through which light leaves the prism for viewing from the forward vehicle;

there being a reflective surface at the bottom of said prism which receives light refracted downwardly by said light inlet surface and reflects said light upwardly toward said light exit surface;

said reflective surface being a generally horizontally extending internally reflective bottom surface of the prism;

said prism having vertically extending opposite side surfaces which are internally reflective to reflect light impinging thereon from the rear vehicle generally forwardly toward said light exit surface.

2. A marker as recited in claim 1, in which said prism has an upper surface which is internally reflective to reflect any light impinging thereon from the rear vehicle generally toward said light exit surface.

3. A road land marker for use with other similar markers in defining a lane or lanes of a road;

said marker including light directing means operable, when the marker is between a forward vehicle and a rear vehicle traveling in the same direction on the road, to receive light emitted forwardly from the headlights of the rear vehicle to said marker and direct said light forwardly from said marker for viewing from said forward vehicle, to indicate to the driver of said forward vehicle the position of said rear vehicle with respect to said marker;

said light directing means including a prism having a light inlet surface through which light from the rear vehicle enters the prism and having a light exit surface through which light leaves the prism for viewing from the forward vehicle;

there being reflective surfaces at opposite sides of said prism for reflecting any light impinging thereon from the rear vehicle generally toward said light exit surface.

4. A road lane marker for use with other similar markers in defining a lane or lanes of a road;

said marker including light directing means operable, when the marker is between a forward vehicle and a rear vehicle traveling in the same direction on the road, to receive light emitted forwardly from the headlights of the rear vehicle to said marker and direct said light forwardly from said marker for viewing from said forward vehicle, to indicate to the driver of said forward vehicle the position of said rear vehicle with respect to said marker;

said light directing means including a prism having a light exit surface through which light from the rear vehicle leaves the prism for delivery forwardly to said forward vehicle, said light exit surface being formed to reflect some of the light from said rear vehicle back to the rear vehicle for viewing by the driver thereof.

5. A marker as recited in claim 4, in which said light exit surface has facets of a first type distributed across its area and shaped to pass light from the rear vehicle forwardly toward the forward vehicle, and has facets of a second type distributed across its area and constructed to reflect at least some of the light from the rear vehicle back to the rear vehicle for viewing by the driver thereof.

6. A marker as recited in claim 5, in which said facets of the second type are corner reflectors.

7. A marker as recited in claim 5, in which said facets of the first type have concave negative lens curvature for spreading the light emitted forwardly from the marker within a limited angle.

8. A marker as recited in claim 7, in which said facets of the second type are corner reflectors.

9. A marker as recited in claim 4, in which said light exit surface is constructed to spread the light delivered forwardly therefrom through a greater angle laterally than vertically.

10. A marker as recited in claim 4, in which said light exit surface has facets with concave negative lens curvature both vertically and transversely to spread the light emitted forwardly within limited angles, said facets being astigmatic to spread the light through a smaller angle vertically than laterally.

11. A marker as recited in claim 10, in which said light exit surface has additional facets which are corner reflectors to reflect light back to the rear vehicle.

12. A marker as recited in claim 5, in which said facets of the first type are constructed to spread the light delivered forwardly therefrom through a greater angle laterally than vertically.

13. A road lane marker for use with other similar markers in defining a lane or lanes of a road;

said marker including light directing means operable, when the marker is between a forward vehicle and a rear vehicle traveling in the same direction on the road, to receive light emitted forwardly from the headlights of the rear vehicle to said marker and direct said light forwardly from said marker for viewing from said forward vehicle, to indicate to the driver of said forward vehicle the position of said rear vehicle with respect to said marker;

said light directing means being constructed to distribute light from one of the headlights of said rear vehicle within a smaller angle vertically than laterally as the light is emitted forwardly from the marker.

14. A marker as recited in claim 13, in which said light directing means includes optical means operable to spread the light from one of the headlights of the rear vehicle laterally, said optical means being astigmatic to confine the light from said one headlight within a smaller angle vertically than laterally.

15. A marker as recited in claim 13, in which said light directing means have an optical surface with a multiplicity of facets having concave negative lens curvature to spread the light emitted forwardly from the marker.

16. A marker as recited in claim 13, in which said light directing means have an optical surface with facets of concave negative lens curvature both vertically and transversely to spread the light emitted forwardly within limited angles, said facets being astigmatic to spread the light through a smaller angle vertically than laterally.

17. A marker as recited in claim 13, in which said light directing means have an exit surface through which the light is emitted forwardly from the marker and which is inclined downwardly and forwardly, with said facets being negative lens surfaces which are astigmatic to spread the light through a smaller angle vertically than laterally.

18. A marker as recited in claim 13, in which said light directing means includes a fresnel lens which is astigmatic to spread light emitted forwardly from the marker through a smaller angle vertically than laterally.

19. A road lane marker for use with other similar markers in defining a lane or lanes of a road;

said marker including light directing means operable, when the marker is between a forward vehicle and a rear vehicle traveling in the same direction on the road, to receive light emitted forwardly from the headlights of the rear vehicle to said marker and direct said light forwardly from said marker for viewing from said forward vehicle, to indicate to the driver of said forward vehicle the position of said rear vehicle with respect to said marker;

said light directing means including an optical element formed of a light passing material through which light from the rear vehicle passes before delivery forwardly to said forward vehicle; said light passing material having a surface which is partially reflective and partially light transmissive to pass some of the light from the rear vehicle through said surface to the forward vehicle and reflect some of the light from the rear vehicle back toward the rear vehicle at said surface;

said surface of the optical element being a light exit surface through which light from the rear vehicle leaves the element for delivery forwardly to said forward vehicle;

said light exit surface having facets of a first type distributed across its area and shaped to pass light from the rear vehicle forwardly toward the forward vehicle within a limited area, and having facets of a second type distributed across its area and constructed to reflect at least some of the light from the rear vehicle back to the rear vehicle for viewing by the driver thereof.

20. A road lane marker for use with other similar markers in defining a lane or lanes of a road;

said marker including light directing means operable, when the marker is between a forward vehicle and a rear vehicle traveling in the same direction on the road, to receive light emitted forwardly from the headlights of the rear vehicle to said marker and direct said light forwardly from said marker for viewing from said forward vehicle, to indicate to the driver of said forward vehicle the position of said rear vehicle with respect to said marker; and a hollow rigid housing through the interior of which light from the headlights of said rear vehicle is directed by said means before emission forwardly from the housing toward the forward vehicle;

said housing having a rear light entrance opening and a forward light exit opening, and having two rigid opposite side walls and a rigid top wall extending therebetween above the path of light between said openings and of a strength to support the weight of an automobile on the housing;

said top wall of the housing having flanges near said light entrance and light exit openings projecting downwardly a short distance and assisting in retaining said light directing means in the housing.

21. A marker as recited in claim 20, in which said light directing means includes a prism within said housing and through which light from the rear vehicle passes prior to emission forwardly toward the forward vehicle; said flanges projecting downwardly at opposite ends of the prism to assist in retaining the prism in the housing.

22. A road lane marker for use with other similar markers in defining a lane or lanes of a road;

said marker including light directing means operable, when the marker is between a forward vehicle and a rear vehicle traveling in the same direction on the road, to receive light emitted forwardly from the headlights of the rear vehicle to said marker and direct said light forwardly from said marker for viewing from said forward vehicle, to indicate to the driver of said forward vehicle the position of said rear vehicle with respect to said marker;

said light directing means including an optical element formed of a light passing material through which light from the rear vehicle passes before delivery forwardly to said forward vehicle; said light passing material having a forwardly facing light exit surface through which light leaves said optical element for delivery forwardly to said forward vehicle, and which light exit surface is partially reflective and partially light transmissive to pass some of the light from the rear vehicle through said light exit surface to the forward vehicle and reflect some of the light from the rear vehicle at said light exit surface back toward the rear vehicle.

23. A marker as recited in claim 22, in which said light exit surface of the optical element has a partially reflective coating acting to pass through the coating a portion of the light from the rear vehicle for viewing from the forward vehicle, and acting to reflect some of the light from the rear vehicle back toward the rear vehicle for viewing by the driver thereof.

24. A marker as recited in claim 22, in which said light exit surface of the optical element has a multiplicity of facets acting to pass a portion of the light from the rear vehicle forwardly to the forward vehicle and to reflect a portion of said light back to the rear vehicle.

25. A marker as recited in claim 20, in which said light directing means includes means forming an upwardly and forwardly inclined light passing optical surface extending across said light inlet opening of the housing and through which light enters the housing, and means forming a downwardly and forwardly inclined light passing optical surface extending across said light exit opening of the housing and through which light leaves the housing.

26. A marker as recited in claim 21, in which said light entrance opening of the housing is inclined upwardly and forwardly and said light exit opening is inclined downwardly and forwardly, said prism having an upwardly and forwardly inclined light inlet surface extending across said light entrance opening and a downwardly and forwardly inclined light exit surface extending across said light exit opening of the housing, said inclined light exit surface being constructed to refract the light forwardly toward said forward vehicle and spread it within limited vertical and lateral angles for viewing from the forward vehicle.

* * * * *